US006217021B1

(12) United States Patent
Ito et al.

(10) Patent No.: US 6,217,021 B1
(45) Date of Patent: Apr. 17, 2001

(54) PAPER MONEY PROCESSING DEVICE

(75) Inventors: Yukio Ito, Iruma-gun; Yasuyuki Kodama, Sakado; Noboru Yamagishi, Tsurugashima; Tadashi Hatamachi, Sakado, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/569,437

(22) Filed: May 12, 2000

(30) Foreign Application Priority Data

May 18, 1999 (JP) ..... 11-137617

(51) Int. Cl.[7] ..... B65H 29/38
(52) U.S. Cl. ..... 271/177; 271/220
(58) Field of Search ..... 271/177–180, 271/181, 220

(56) References Cited

U.S. PATENT DOCUMENTS 4,765,607 * 8/1988 Zouzoulas ..... 271/177
5,286,017 * 2/1994 Hawk et al. ..... 271/180 X
5,505,439 * 4/1996 Watabe et al. ..... 271/177
5,509,646 * 4/1996 Chang ..... 271/177

FOREIGN PATENT DOCUMENTS 63-208440 * 8/1988 (JP) ..... 271/180
3-46955 * 2/1991 (JP) ..... 271/180

* cited by examiner

*Primary Examiner*—David H. Bollinger
(74) *Attorney, Agent, or Firm*—Welsh & Katz, Ltd.

(57) ABSTRACT

Stacker (2) of the paper money processing device (1) is provided with L-shaped levers (4) whose front end (4*a*) is formed to be orientated upward and which rotatably support auxiliary rollers (5) at the front end (4*a*), and a thrusting member (6) which thrusts the L-shaped levers (4) toward a paper money carrier belt (26) of the device main body (22) constantly. The stacker (2) is constructed in such a way that, when it is mounted in the device main body (22), a paper money inserted is held and carried between the auxiliary rollers (5) and the paper money carrier belt (26) by the thrusting force of the thrusting member (6), and when the stacker (2) is removed from the device main body (22), a paper money housed within the stacker (2) is prevented from falling down from the stacker (2) by the L-shaped levers (4).

8 Claims, 9 Drawing Sheets

PAPER MONEY PROCESSING DEVICE

BACKGROUND OF THE INVENTION

1. Field of the Invention

The present invention relates to a paper money processing device for use in, for example, automatic vending machines, money-changing machines, pachinko ball vending machines and metal token vending machines.

2. Description of the Related Art

Generally, paper money processing devices are mounted in the main bodies of devices such as automatic vending machines which handle paper money (including coupons and so on) to judge the authenticity of the paper money which has been inserted, and to store and house only that paper money which has been deemed authentic.

FIG. 8 is a partially broken schematic side view that shows the main part of a conventional paper money processing device.

The conventional paper money processing device 21 comprises a device main body 22, and a stacker 52 mounted so as to be attachable to and detachable from the rear surface 22*a* of the main body 22.

Arranged in the device main body 22 are paper money carrier means 25 which comprises a paper money carrier belt 26 for transporting paper money 101 inserted through a paper money insertion hole 23 along an L-shaped paper money carrier path 24; paper money identification means 42 which comprises a magnetic head or the like for judging the authenticity of the paper money 101; and paper money transfer means 35 for transferring to the stacker 52 each piece of paper money 101 judged to be authentic by the paper money identification means 42 one by one.

The paper money carrier means 25 comprises the aforementioned endless paper money carrier belt 26 which extends along a horizontal part 24*a* or a vertical part 24*b* of a paper money carrier path 24, and paper money carrier belt drive means 31 comprising pulleys 27, 28, 29, 30 which rotate and drive the paper money carrier belt 26.

The paper money transfer means 35 is, as disclosed in the specification of Japanese Patent Application No. 5-276592 which was previously proposed by the applicants of the subject application, arranged in the longitudinal direction over the opposite sides of the device main body 22 and comprises a pair of paper money guide drums 36 which are supported, taking the top and bottom ends thereof as the axis, so as to be able to rotate freely in one direction. Referring to FIG. 9 which shows a main part schematic cross-sectional view of FIG. 8, the circumferential surface of the paper money guide drums 36 is formed with a slit 36*a*, into which the edge part in the width direction of the paper money 101 inserts, along the vertical part 24*b* of the paper money carrier path 24. It will be noted that the reference symbols 32, 33 of FIG. 9 denote, respectively, the upper chute and the lower chute which form the paper money carrier path 24.

For details of paper money transfer means 35, please refer to Japanese Patent Application No. 5-276592.

Meanwhile, the stacker 52 shown in FIG. 8 comprises a housing 53 in which an opening 53*a* which faces the front surface is formed. As shown in FIG. 9, an auxiliary roller 55 for holding the paper money between itself and the paper money carrier belt 26 so as to transport the paper money, is rotatably supported at the bottom edge 53*b* of the housing 53, and at a portion of the stacker 52 which opposes the paper money carrier belt 26.

In the conventional paper money processing device 21, when a paper money 101 is inserted into the paper money insertion hole 23 shown in FIG. 8 and the presence or absence of paper money 101 is detected by a paper money detection sensor not shown in the drawings, the paper money carrier belt 26 rotates in the anti-clockwise direction based on the detected signal, whereby the paper money 101 is horizontally transported along the horizontal part 24*a* of the paper money carrier path 24 by the carrier force thereof. At this time, shutter means 41 is driven and as a result, the shutter is moved to the left direction in the drawing so that the vertical part 24*b* of the paper money carrier path 24 opens wider.

When the paper money 101 is transported approximately 90° upward along the vertical part 24*b* of paper money carrier path 24, a judgement is made as to the authenticity of the paper money 101 by paper money identification means 42. If the paper money 101 is judged not to be authentic, the paper money carrier belt 26 reverses (rotates in the clockwise direction) so that the paper money 101 is returned through the paper money insertion hole 23.

Meanwhile, if the paper money 101 is judged to be authentic by paper money identification means 42, the forward rotation of the paper money carrier belt 26 is continued based on the detected signal, and the paper money 101 is transported further downstream of the vertical part 24*b*.

When the paper money 101 reaches the auxiliary roller 55 shown in FIG. 9, the paper money 101 is held between the auxiliary roller 55 and the forward rotating paper money carrier belt 26 whereby further transporting into the downstream slit 36*a* is ensured.

When the front end of the paper money 101 is inserted into the bottom edge of the slit 36*a* of the paper money guide drums 36, the paper money 101 is simultaneously held between the paper money carrier belt 26 and the edge part of the slit 36*a* of the paper money guide drums 36. As a result, the paper money 101 is transported further upward along the slit 36*a*. After that, when the paper money 101 is detected as having reached a predetermined position in the slit 23 by a sensor or the like not shown in the drawings, the forward rotation of the paper money carrier belt 26 stops and the paper money guide drums 36 rotate in the same phase in the opposite direction. As a result, the paper money 101 inserted in the slit 36*a* moves parallel to the stacker 52.

When the paper money 101, which is moving parallel to the stacker, reaches the stacker 52, the paper money 101 is held between the outer circumferential surface of the paper money guide drums 36 and a stacker plate, not shown in the drawings, by way of a stacker spring not shown in the drawings. At the same time, it is pushed by a chute not shown in the drawings moving toward the stacker 52 in response to the rotation of the paper money guide drums 36, so the paper money 101 is released from the slit 36*a*. As a result, it is pushed into and housed with certainty in the stacker 52.

In this conventional paper money processing device 21, the stacker 52 can be attached to and detached from the device main body 22. When the paper money housed within the stacker 52 is to be collected, or a maintenance inspection of the device main body 22 is carried out, the stacker 52 is detached from the device main body 22 so that the operations for the maintenance can be easily carried out.

However, in the conventional paper money processing device 21, an opening 53*a* which faces the device main body 22 is formed in the stacker 52 in which the paper money 101 is housed. Therefore, there are problems in that, when the device main body 22 is separated from the stacker 52 at the time of a collection of the paper money housed within the stacker 52 or a maintenance inspection of the device main body 22, the housed paper money 101 of the stacker 52 is liable to fall downward from the stacker 52.

SUMMARY OF THE INVENTION

An object of the invention is to provide a paper money processing device which can transport the paper money with stability, and which, when the paper money is collected and the like, prevents the falling, as far as possible, of the housed paper money in the stacker.

In order to achieve the above-described objects, the present invention provides a paper money processing device comprising a device main body having a paper money carrier belt for transporting a paper money inserted through a paper money insertion hole; and a stacker removably mounted to the device main body for housing the paper money which is transported by means of the paper money carrier belt, the stacker rotatably supporting an auxiliary roller which is arranged opposing the paper money carrier belt, the auxiliary roller and the paper money carrier belt transporting a paper money by holding the paper money therebetween, characterised in that the stacker is provided with an L-shaped lever whose front end is formed to be orientated upward and rotatably supports the auxiliary roller; and force applying means for thrusting the L-shaped lever toward the paper money carrier belt constantly, whereby the paper money is held and carried between the auxiliary roller and the paper money carrier belt by the thrusting force of the force applying means when the stacker is mounted in the device main body, and the paper money housed in the stacker is prevented from falling from the stacker by the L-shaped lever when the stacker is removed from the device main body.

It will be noted that the other objects and effects of this invention can be confirmed easily by the following detailed description and attached drawings.

DESCRIPTION OF THE PREFERRED EMBODIMENTS

A detailed description of an embodiment of the paper money processing device according to the present invention is given below.

Figure 1:
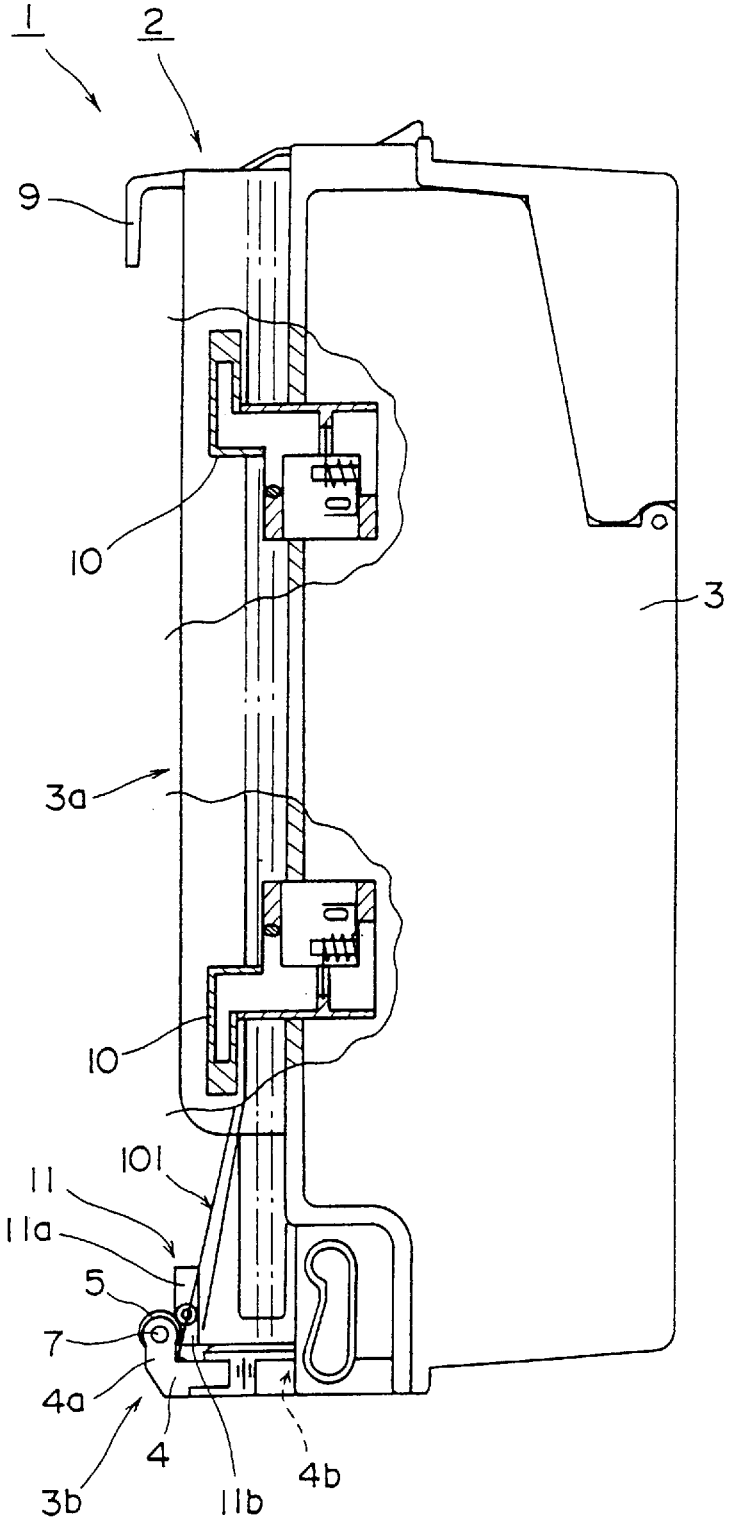
FIG. 1 is a partially broken schematic side view which shows the main part of a stacker that constitutes the paper money processing device according to the present invention.
Figure 8:
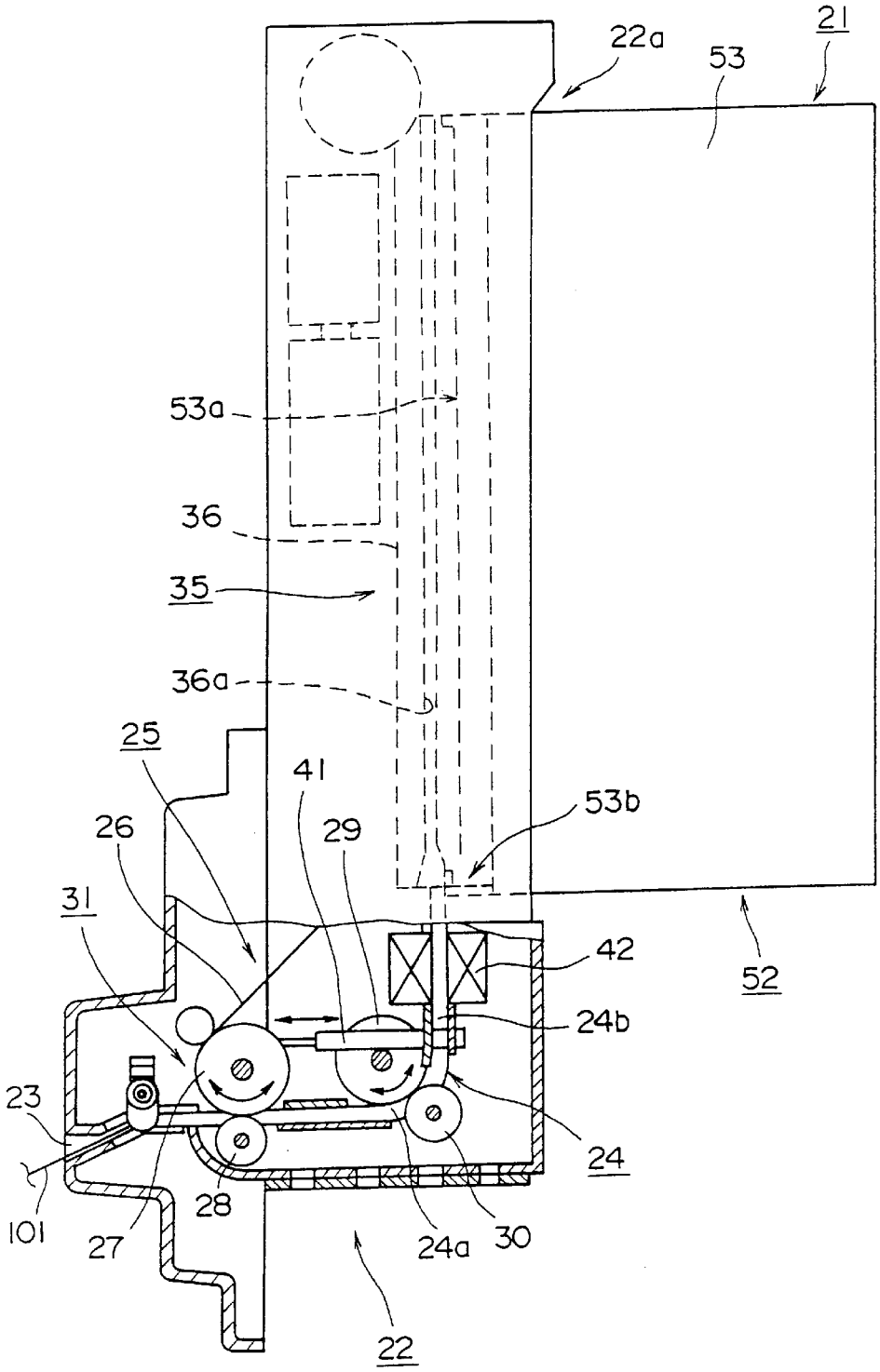
FIG.8 PRIOR ART
FIG. 8 is a partially broken schematic side view that shows the main part of a conventional paper money processing device.
Figure 9:
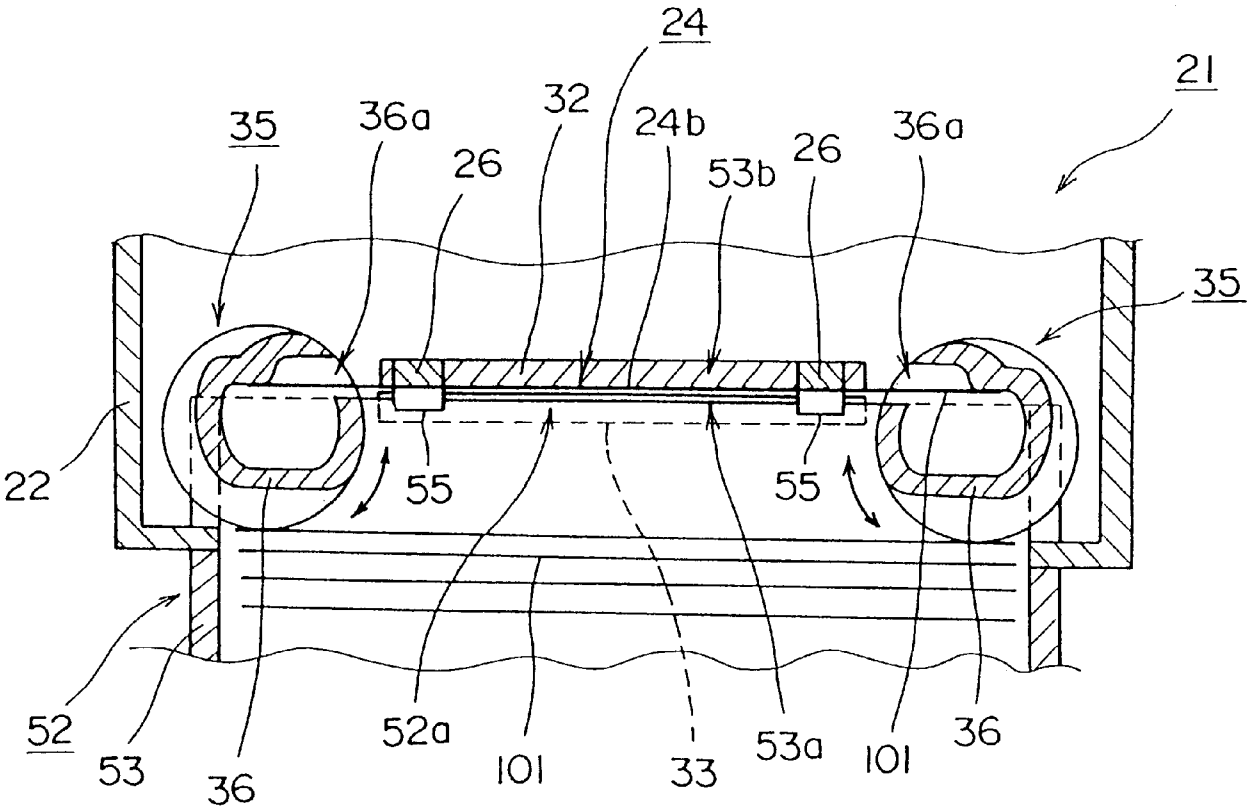
FIG.9 PRIOR ART
FIG. 9 is a schematic cross-sectional view of the main part that shows the operation of the conventional paper money processing device.

Referring to FIG. 1 that is a partially broken schematic side view that shows a state in which the stacker 2 is separated from the device main body 22, the paper money processing device 1 according to the present invention comprises a device main body 22 of the conventional type shown in FIG. 8, and a stacker 2, which is mounted so as to be freely attachable to and detachable from the rear surface 22*a* of the device main body 22.

The stacker 2 comprises a housing 3 in which an opening 3*a* which faces toward the front surface is formed, L-shaped levers 4 arranged in the side bottom edge 3*b* of the opening 3*a* of the housing 3, an auxiliary roller 5 supported so as to have freedom to rotate by way of axis 7 in the front end 4*a* of the L-shaped levers 4, and the force applying means 6 (FIG. 3) which urge the L-shaped levers 4 to the front surface side constantly.

Hooks 10 to prevent falling of the paper money are arranged at the sides of the housing 3 and a paper money reversing prevention lever 11 that protrudes toward the opening 3*a* is arranged in the bottom edge 3*b*. The paper money reversing prevention lever 11 is a 2-level folding lever comprising a first lever element 11*a* and a second lever element 11*b*.

Figure 2:
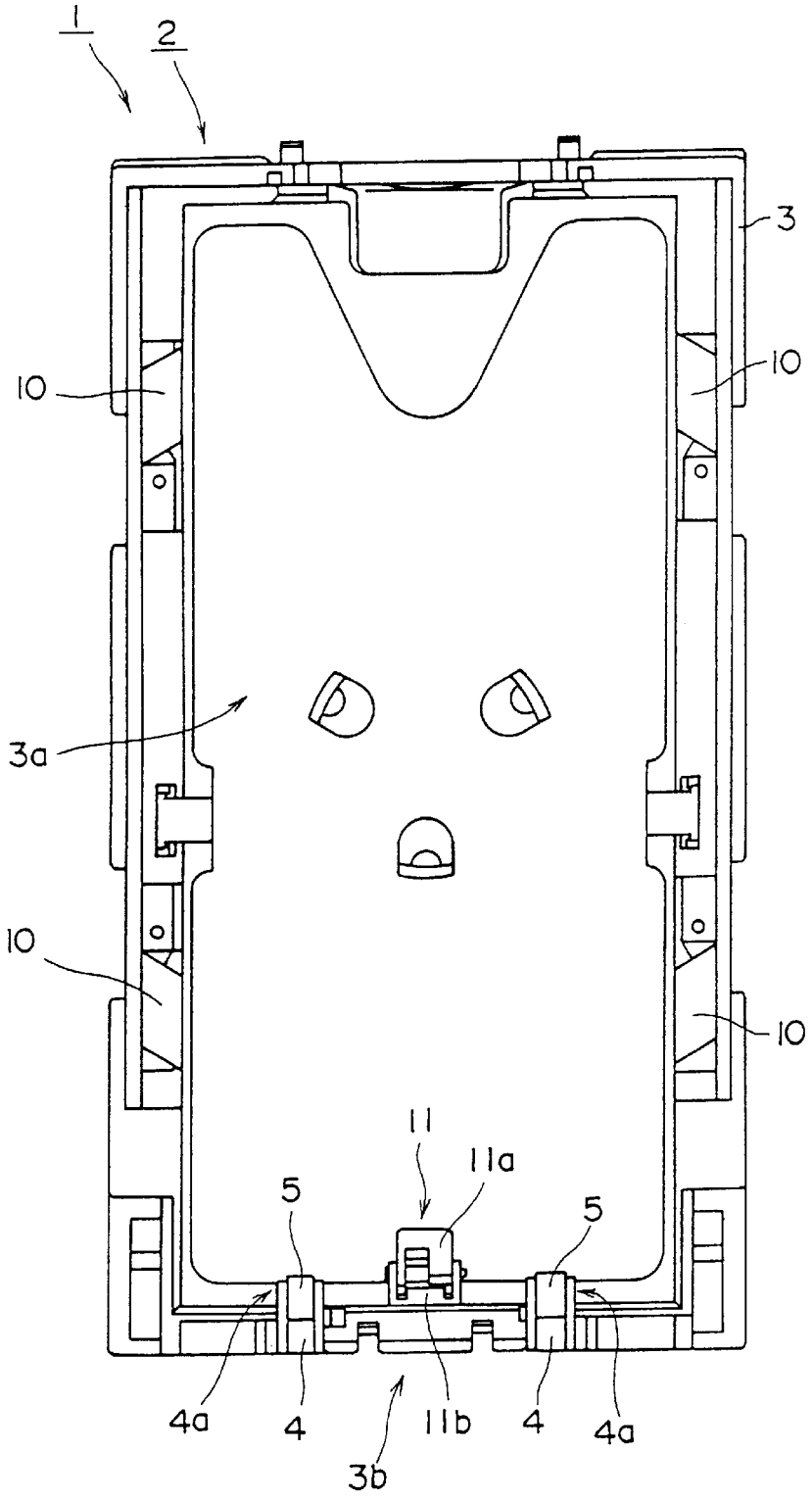
FIG. 2 is a schematic front view which shows the stacker which constitutes the paper money processing device according to the present invention in a state in which it is mounted on the device main body.

FIG. 2 is a schematic front view which shows the state of the stacker 2 when it is mounted on the device main body 22, and the same reference symbols are used to show the same parts as those of FIG. 1. As shown in FIG. 2, the paper money reversing prevention lever 11 is arranged in the approximate center of the bottom edge 3*b*.

Meanwhile, the L-shaped levers 4 shown in FIG. 1 comprise a front end 4*a* formed in the upward direction and a back edge 4*b* supported by the housing 3. As shown in FIG. 2, the L-shape levers 4 are arranged at the bottom edge 3*b* of the housing 3 on opposite sides of the paper money reversing prevention lever 11 enclosing the latter in the width direction.

Figure 3:
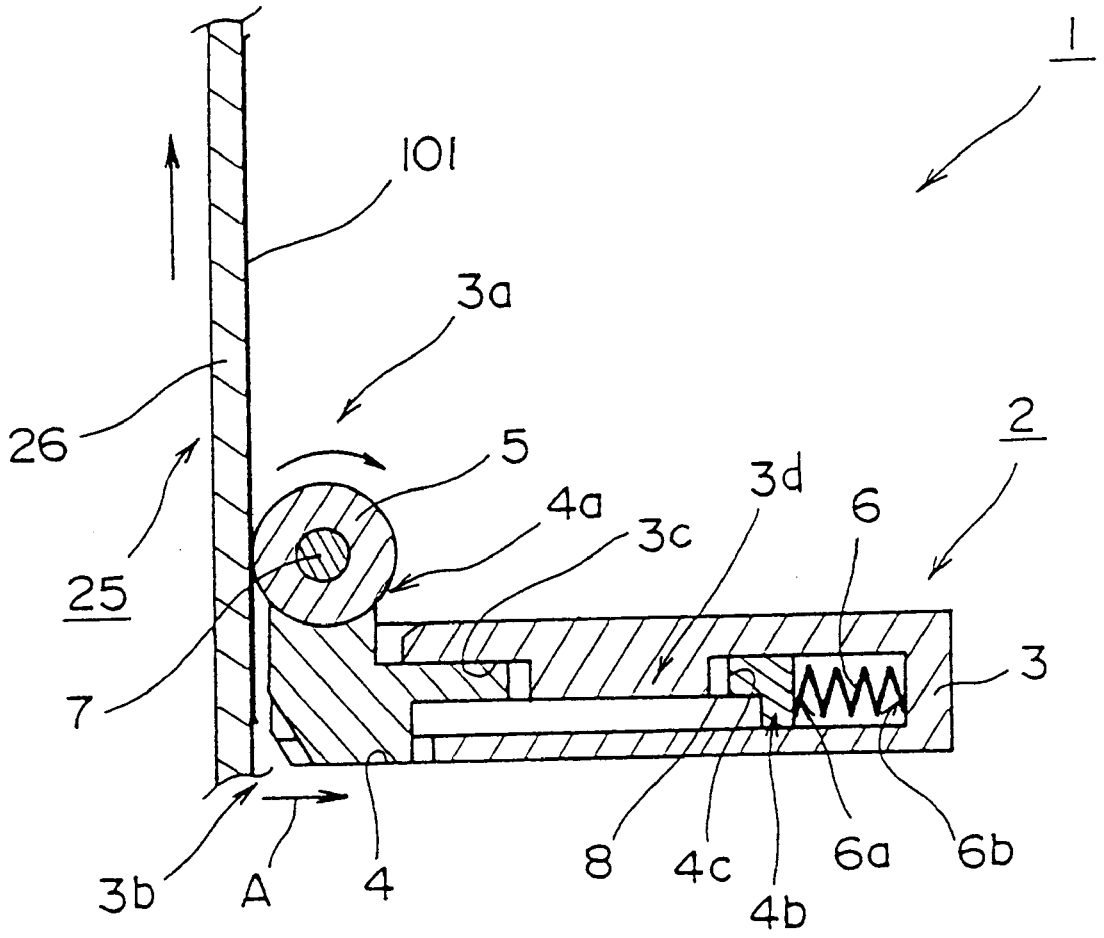
FIG. 3 is a schematic cross-sectional view of the main part which shows the operation of the stacker that constitutes the paper money processing device according to the present invention when it is mounted on the device main body.

Referring to FIG. 3 which shows the main part schematic cross-sectional view of the paper money processing device 1, the back edge 4*b* of the L-shaped levers 4, insert into a support groove 3*c* within the housing 3, and are engaged with a support part 3*d* of the housing 3 by a guide groove 8 formed in the bottom edge 4*b* side, and by virtue of this, the L-shaped levers 4 are supported to have the freedom to slide across a predetermined distance with respect to the housing 3.

The force applying means 6 which urges the L-shaped levers 4 to the front surface side of the stacker 2 is a spring arranged in the support groove 3*c* of the housing 3. The force applying means 6 comprises a front end 6*a* which is connected with the back edge 4*b* of the L-shaped levers 4, and a back edge 6*b* connected by the housing 3 of the stacker 2.

It will be noted that the same reference symbols of FIG. 3 denote the same parts as those of FIG. 1 and 8.

Now, the operation of the paper money processing device 1 described above is described below, along with a more detailed description of the configuration of the paper money processing device 1.

In the paper money processing device 1, a projecting part 9 is formed at the upper part of the stacker 2 shown in FIG. 1. By fitting the projecting part 9 of the stacker 2 into a groove for mounting not shown in the drawings formed upper part in the longitudinal direction at the rear surface 22*a* of the device main body 22, the stacker 2 is mounted in the device main body 22 in the same way as the conventional paper money processing device 21 shown in FIG. 8.

Figure 4:
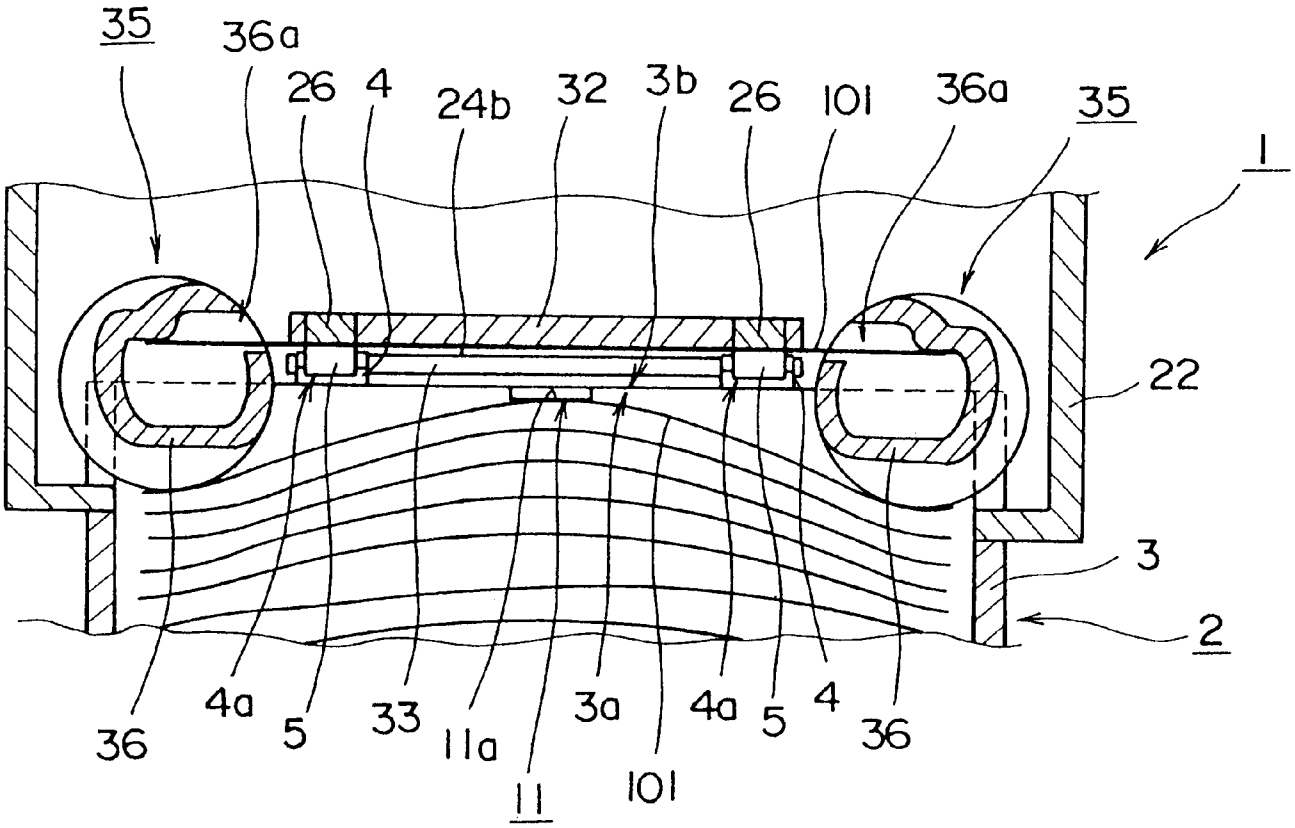
FIG. 4 is a schematic cross-sectional view of the main part which shows the operation of the stacker that constitutes the paper money processing device according to the present invention when it is mounted on the device main body.

When the stacker 2 is mounted in the device main body 22 in this way, paper money fall prevention hooks 10 retreat from the opening 3*a* in the stacker 2 as shown in FIG. 2. In addition, as shown in FIG. 4 which shows a main part schematic cross-sectional view of the paper money processing device 1, the paper money reversing prevention lever 11 is arranged between the pair of paper money guide drums 36.

Further, as shown in FIG. 3, the L-shaped levers 4 resist the thrusting force of the force applying means 6 and slide along the guide groove 8 of the support groove 3*c* to the opposite side to the paper money carrier belt 26 (direction of the arrow A). In addition, as shown in FIG. 4, the auxiliary rollers 5 rotatably supported by the front end 4*a* of the L-shaped levers 4 are arranged opposite the paper carrier money belt 26 and pressure-contact the paper money carrier belt 26 due to the thrusting force of the force applying means 6.

With the above configuration, when the paper money 101 is judged to be authentic by paper money identification means 42 arranged in the device main body 22 and is transported to the vertical part 24*b* of the paper money carrier path 24 by the forward rotation of the paper money carrier belt 26, the paper money 101 can be transported downstream into a slit 36*a* with certainty. This is because the paper money 101, as shown in FIG. 3 and FIG. 4, is held between the auxiliary roller 5 and the paper money carrier belt 26 by the thrusting force of the force applying means 6.

It will be noted that, after the paper money 101 has been transported into the slit 36*a* as described above, it is grasped between the paper money carrier belt 26 and the edge part of the paper money guide drum 36 and is moved parallel toward the opening 3*a* of the stacker 2. At this time, the paper money reversing prevention lever 11 is pushed by the bottom edge of the paper money and retreats within a hole not shown in the drawings while resisting against force applying means not shown in the drawings. Therefore, the holding operation of the paper money 101 can be performed smoothly. In addition, when the paper money 101 is housed within the housing 3 of the stacker 2, the paper money reversing prevention lever 11 is restored by the thrusting force of another force applying means (not shown) to an initial state shown in FIG. 1 so that the bottom edge of the paper money 101 housed in the housing 3 is covered and restricted at its approximate center by the paper money reversing prevention lever 11 as shown in FIG. 4. As a result, projection of the approximate center of the paper money in the width direction into the paper money carrier path 24 and obstructing the transportation of the paper money 101 which is next to be housed are prevented.

Meanwhile, for the stacker 2 to be separated from the device main body 22, the engagement between the above-mentioned mounting groove of the device main body 22 and the projecting part 9 of the stacker 2 shown in FIG. 1 should be released.

Figure 5:
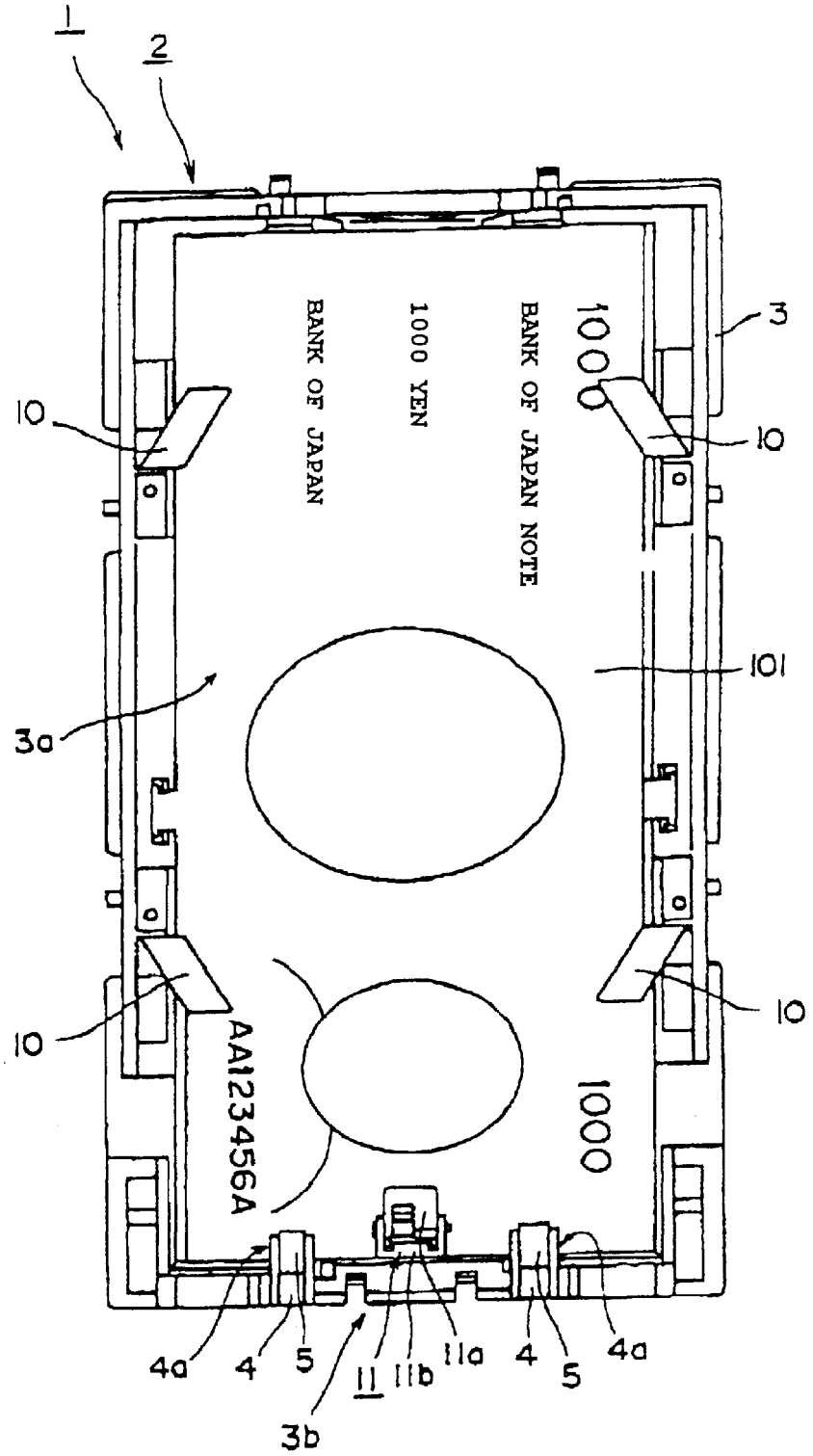
FIG. 5 is a schematic front view which shows the stacker which constitutes the paper money processing device according to the present invention in a state in which it is separated from the device main body.
Figure 6:
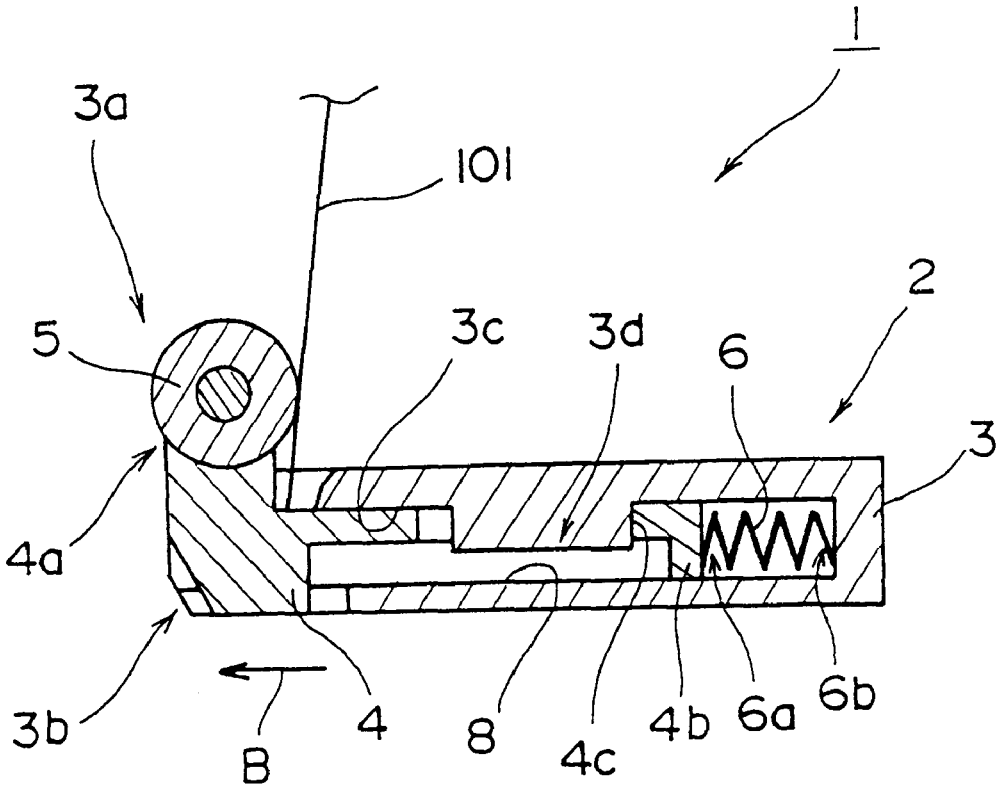
FIG. 6 is a schematic cross-sectional view of the main part which shows the operation of the stacker that constitutes the paper money processing device according to the present invention when it is separated from the device main body.

When the stacker 2 is separated from the device main body 22 in the above-described manner, the paper money fall prevention hooks 10 project toward the opening 3*a* as shown in FIG. 5 which shows the separated state of the stacker 2, and the L-shaped levers 4 slide to the paper money carrier belt 26 (direction of arrow B) due to the thrusting force of the force applying means 6 along the guide groove 8 in the supporting groove 3*c* and are restored to the initial state as shown in FIG. 6.

FIG. 6 shows the same part as FIG. 3 and is a schematic cross-sectional view of the main part of the paper money processing device 1, in which the reference symbol 4*c* indicates a stopper which abuts the support part 3*d* of the housing 3 to regulate the slide of the L-shaped levers 4 toward the paper money carrier belt 26.

Because the front end 4*a* of the L-shaped levers 4 which are restored to the initial state in this way is orientated upward, the bottom edge of the paper money 101 housed within the stacker 2 is covered and restrained by the L-shaped levers 4 from below and from the front surface, and for that reason, when the stacker 2 is separated from the device main body 22 in the paper money processing device 1, the falling of the paper money 101 housed within the stacker 2 from below the stacker 2 can be prevented.

Accordingly, when a maintenance inspection operation of the device main body 22 or a collection operation of the paper money within the stacker 2 is carried out while the stacker 2 is separated from the device main body 22, the falling of the paper money 101 housed within the stacker 2 from the stacker 2 can be prevented. By virtue of this, the maintenance inspection operation of the device main body 22 and recovery operation of the paper money 101 housed within the stacker 2 can be carried out simply and safely.

In the paper money processing device 1, the L-shaped levers 4 are arranged in opposite sides of the stacker 2 in the width direction. Therefore, as in FIG. 7 in which the parts the same as FIG. 4 are denoted by same reference symbols, the bottom edge at opposite sides of the paper money 101 in the width direction are covered and restrained by these two L-shaped levers 4, and the falling of the paper money 101 from the underside of the stacker 2 can, for that reason, be even further prevented.

Further, because the auxiliary rollers 5 are rotatably supported in the front end 4*a* of the L-shaped levers 4 in the paper money processing device 1, the bottom edge of the paper money 101 housed within the stacker 2 is covered from below and from the front surface by the L-shaped levers 4, and is also covered and restrained from the front surface by the auxiliary rollers 5, so the falling of the paper money 101 below the stacker 2 can be even further prevented by the auxiliary rollers 5.

When the stacker 2 is separated from the device main body 22 in the paper money processing device 1, the paper money fall prevention hooks 10 project toward the opening 3*a* as shown in FIG. 5. As a result, the side of the paper money 101 is covered and restrained by the paper money fall prevention hooks 10. Thus, when the stacker 2 is released from the device main body 22 the falling of the paper money 101 within the stacker 2 from the side of the stacker 2 can be even further prevented.

Figure 7:
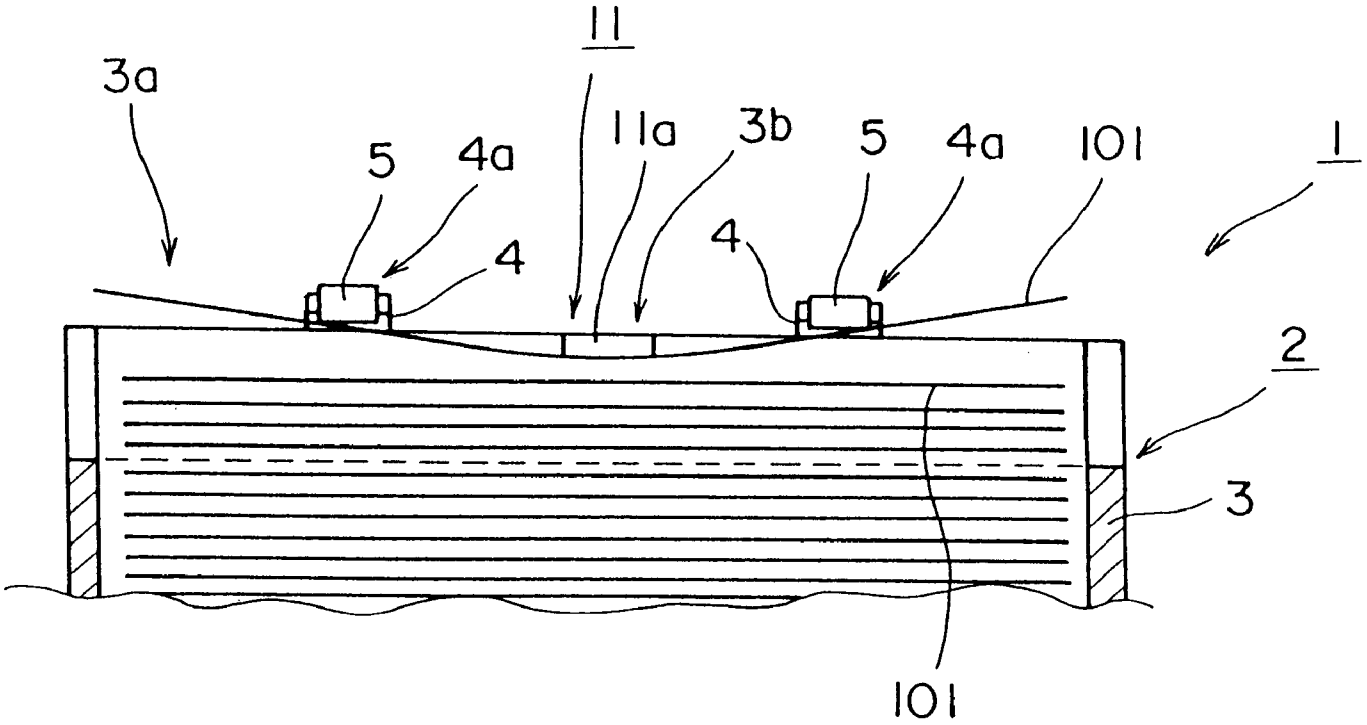
FIG. 7 is a schematic cross-sectional view of the main part which shows the operation of the stacker that constitutes the paper money processing device according to the present invention when it is separated from the device main body.

In the paper money processing device 1, the paper money reversing prevention lever 11 is arranged in the approximate center of the stacker 2 in the width direction, and, as described above, the paper money reversing prevention lever 11 completes the holding operation of the paper money and restores to the initial state when the stacker 2 is separated from the device main body 22. Therefore, as shown in FIG. 7, the opposite sides at the lower side of the paper money 101 are covered and restrained by the L-shaped levers 4, and an approximately center at the lower side thereof is restrained and covered by the paper money reversing prevention lever 11. For this reason, the falling of the paper money 101 housed within the stacker 2 below the stacker 2 can be further prevented.

Accordingly, in the paper money processing device 1, when the stacker is separated from the device main body 22 and a maintenance inspection operation of the device main body 22 or a collection operation of the paper money 101 from the stacker 2 is carried out, the falling of the paper money 101 housed within the stacker 2 below the stacker 2 can be prevented as far as possible. As a result, the maintenance inspection operation of the device main body 22 and the collection operation of the paper money 101 from the stacker 2 can be carried out even more simply and safely.

It will be noted that, in the paper money processing device 1 of the present embodiment, two L-shaped levers 4 are adopted, and as a result, the falling of the paper money 101 within the stacker 2 as described above is further prevented. However, according to the paper money processing device of the present invention the number of L-shaped levers 4 is not limited to this. By way of example, one L-shaped lever 4 may be arranged to comply with the paper money carrier belt 26, and in this case as well, the front end 4*a* of the L-shaped lever 4 covers and restrains the underneath of the paper money 101, and the falling of the housed paper money 101 below the stacker 2 is, as far as possible, prevented.

In addition, the paper money reversing prevention lever 11 in the stacker 2 is provided in the paper money processing device 1 of this embodiment, and when the stacker 2 is separated from the device main body 22, falling of the paper money within the stacker 2 is also prevented by the paper money reversing prevention lever 11 as described above, thereby to further heighten the preventive effect of the falling of the housed paper money. However, if the paper money processing device of the present invention is provided with an L-shaped lever 4 in the stacker 2, a paper money reversing prevention lever 11 need not be provided, and it goes without saying that in a paper money processing device of this kind as well, the front end 4*a* of the L-shaped lever 4 covers and restrains the underneath of the paper money 101 wherein the falling of the housed paper money 101 below the stacker 2 can be even further prevented.

In addition, the paper money fall prevention hooks 10 is provided in the paper money processing device 1 of this embodiment, and when the stacker 2 is separated from the device main body 22, falling of the paper money within the stacker 2 is also prevented by the paper money fall prevention hooks 10, thereby to further heighten the preventive effect of the falling of the housed paper money. However, if the paper money processing device of the present invention is provided with an L-shaped lever 4 in the stacker 2, paper money fall prevention hooks 10 need not be, and it goes without saying that in a paper money processing device of this kind as well, the falling of the housed paper money within the stacker 2 can be prevented.

As is described above, because the paper money processing device of the present invention is a paper money processing device which comprises a device main body which comprises a paper money carrier belt for transporting paper money inserted through a paper money insertion hole, and a stacker mounted so as to be attachable to or detachable from the device main body and which in its inner part houses the paper money which is transported by means of the paper money carrier belt, and the stacker is arranged opposing the paper money carrier belt and supports auxiliary rollers which hold and transport the abovementioned paper money between the abovementioned paper money carrier belt so they are able to rotate, and the abovementioned stacker, in which the front end thereof is formed to be orientated upward, comprises L-shaped levers which support the abovementioned auxiliary rollers in the front end, and the force applying means which urge the L-shaped levers to the abovementioned paper money carrier belt side constantly, when the abovementioned stacker is mounted in the abovementioned device main body, the abovementioned paper money is held between the abovementioned auxiliary rollers and is transported, and when the abovementioned stacker is separated from the abovementioned device main body the falling of the abovementioned paper money housed within the abovementioned stacker from the abovementioned stacker is prevented by the L-shaped levers.

Accordingly, a paper money processing device can be provided which, carries paper money with stability, and which, when the paper money is collected or the like, prevents, as far as possible, the falling of the housed paper money within the stacker.

The present invention can be, provided they do not stray from the concept and principal characteristics thereof, embodied in a variety of modes, and for that reason, the above-described embodiment provides an example only in many points and must not be interpreted as being limited to this. The scope of the invention is indicated by the scope of the patent claims and there are absolutely no restrictions in the main text of the specification. Furthermore, the changes and alterations, which fall within the equivalent scope of the scope of the patent claims, will all lie within the scope of the invention.

What is claimed is:

1. A paper money processing device comprising:

a device main body having a paper money carrier belt for transporting a paper money inserted through a paper money insertion hole; and a stacker removably mounted to the device main body for housing the paper money which is transported by means of the paper money carrier belt, the stacker rotatably supporting an auxiliary roller which is arranged opposing the paper money carrier belt, the auxiliary roller and the paper money carrier belt transporting a paper money by holding the paper money therebetween, characterised in that the stacker is provided with an L-shaped lever whose front end is formed to be orientated upward and rotatably supports the auxiliary roller; and force applying means for thrusting the L-shaped lever toward the paper money carrier belt constantly, whereby the paper money is held and carried between the auxiliary roller and the paper money carrier belt by the thrusting force of the force applying means when the stacker is mounted in the device main body, and the paper money housed in the stacker is prevented from falling from the stacker by the L-shaped lever when the stacker is removed from the device main body.

2. The paper money processing device according to claim 1, wherein the L-shaped lever is arranged in each of opposite sides of the stacker in the width direction.

3. The paper money processing device according to claim 1, wherein the stacker comprises a paper money reversing prevention lever for preventing paper money housed in the stacker from reversing.

4. The paper money processing device according to claim 3, wherein the L-shaped lever is provided in each of opposite sides in the width direction of the stacker so that the paper money reversing prevention lever is interposed therebetween.

5. The paper money processing device according to claim 1, wherein the stacker comprises hooks for preventing paper money from falling down.

6. The paper money processing device according to claim 5, wherein the L-shaped lever is arranged in a lower end of a housing of the stacker, and the hooks for preventing paper money from falling down are arranged on sides of the housing of the stacker.

7. The paper money processing device according to claim 1, wherein the stacker comprises a paper money reversing prevention lever and hooks for preventing paper from falling down.

8. The paper money processing device according to claim 7, wherein the L-shaped lever is arranged in a lower end of a housing of the stacker and on each of opposite sides of the stacker in the width direction so that the paper money reversing prevention lever is interposed therebetween, and the hooks for preventing paper money from falling down are arranged on sides of the housing of the stacker.

* * * * *